US009114271B1

(12) United States Patent
Brown

(10) Patent No.: US 9,114,271 B1
(45) Date of Patent: Aug. 25, 2015

(54) MULTIPLE EXERCISE APPARATUS FOR AEROBIC AND STRENGTH TRAINING

(71) Applicant: Collis Brown, Marshfield, MA (US)

(72) Inventor: Collis Brown, Marshfield, MA (US)

( * ) Notice: Subject to any disclaimer, the term of this patent is extended or adjusted under 35 U.S.C. 154(b) by 355 days.

(21) Appl. No.: 13/655,611

(22) Filed: Oct. 19, 2012

(51) Int. Cl.
*A63B 21/00* (2006.01)

(52) U.S. Cl.
CPC ..... *A63B 21/00* (2013.01)

(58) Field of Classification Search
USPC ..... 482/35, 41
See application file for complete search history.

(56) References Cited

U.S. PATENT DOCUMENTS

| | | | | |
|---|---|---|---|---|
| 2,885,233 | A * | 5/1959 | Horowitz | 403/170 |
| 4,159,113 | A | 6/1979 | Callecod | |
| 4,789,152 | A | 12/1988 | Guerra | |
| 5,011,139 | A | 4/1991 | Towley | |
| 5,540,639 | A | 7/1996 | Potts et al. | |
| 6,001,020 | A | 12/1999 | Nagelski et al. | |
| 6,517,467 | B1 | 2/2003 | Sutton et al. | |
| 6,699,163 | B2 | 3/2004 | Gallagher | |
| 6,749,549 | B1 | 6/2004 | Chu | |
| 6,991,550 | B1 | 1/2006 | Zeilinger et al. | |
| 7,060,002 | B1 | 6/2006 | Boehme | |
| 7,077,191 | B2 | 7/2006 | Merkle | |
| 7,361,125 | B2 | 4/2008 | Webber et al. | |
| 7,364,530 | B2 * | 4/2008 | Lopez | 482/38 |
| 7,534,200 | B1 | 5/2009 | Martinez | |
| 7,617,637 | B2 | 11/2009 | Yates | |
| 7,621,847 | B2 | 11/2009 | Lamle et al. | |
| 7,662,067 | B2 | 2/2010 | Payne | |
| 7,867,144 | B2 | 1/2011 | Quinn | |
| 8,002,642 | B2 * | 8/2011 | Guerzini et al. | 472/116 |

* cited by examiner

*Primary Examiner* — Jerome w Donnelly
(74) *Attorney, Agent, or Firm* — Kevin J. Snyder; John V. Stewart

(57) ABSTRACT

A flight of stairs (22) and a slide (26) with respective top ends (23, 27) adjacent to each other and spanned by a platform (29). Respective bottom ends (48, 46) are adjacent to each other. A hand grip mounting portion (32) of the apparatus has a horizontal upper surface (33) within 3 feet or preferably within 16-22 inches above a floor (60) for sitting in preparation for dips. One or more pairs of hand grips (34, 36, 37) extend outwardly at an angle of 0-40 degrees from such mounting portion within 6 inches below the horizontal surface (33) or preferably within 3 inches. The grips are retractable (36) into or against the mounting portion (32). The slide (26) may have a peak (28) that increases headroom for inclined pushups on handgrips (37) below it. Other exercise devices (54, 56, 59) may be attached for multiple concurrent users.

20 Claims, 5 Drawing Sheets

MULTIPLE EXERCISE APPARATUS FOR AEROBIC AND STRENGTH TRAINING

FIELD OF THE INVENTION

This invention relates to exercise apparatus and particularly to exercise apparatus with multiple exercise stations.

DESCRIPTION OF PRIOR ART

Exercise equipment is often specialized for one type of exercise. An exercise machine for strength training may include a bench and movable handles with variable-resistance for presses, flys, curls, and pull-overs. Exercise machines for aerobics include treadmills, stair steppers, elliptical trainers, rowing machines, and stationary bicycles.

Exercise machines may have complex moving mechanisms like pivoting levers, springs or bungee straps, moving weights, cables and pulleys, cranks, pedals, moving belts, moving stairs, electric motors, and resistance or speed adjustment mechanisms. Such mechanisms require substantial maintenance, and are subject to wear and malfunction over time.

Some exercise equipment has no moving parts or only simple moving parts, but may be specialized by age group. Examples include monkey bars, play tubes, and slides as in U.S. Pat. No. 6,001,020, which are specialized for children. Stationary pull-up bars are mainly useful for people with high strength-to-weight ratios.

Some exercises are too difficult for many people of average or below-average fitness, depending on their weight and strength. Dips, pull-ups, and push-ups fall into this category.

SUMMARY OF THE INVENTION

An object of the invention is an apparatus that provides both aerobic and strength training for users over a wide range of ages, fitness levels, heights, and weights.

Another object is such an apparatus that provides easier dips, pull-ups, and push-ups that can be performed by users over a wide range of ages, fitness levels, heights, and weights.

Another object is such apparatus with only simple moving parts that may include retractable hand grips for dips and inclined push-ups, and may further include a suspended bar and/or suspended hand rings for inclined pull-ups.

Another object is such apparatus providing hand grips with an angle for inclined push-ups that matches the angle of a user's wrists beside the torso for reduced stress on the wrists.

Another object is such apparatus that can be used by multiple users concurrently.

Another object is such apparatus with compactness and inherent rigidity.

These objects are met by the apparatus described and shown by example herein.

DETAILED DESCRIPTION OF THE INVENTION

Figure 1:
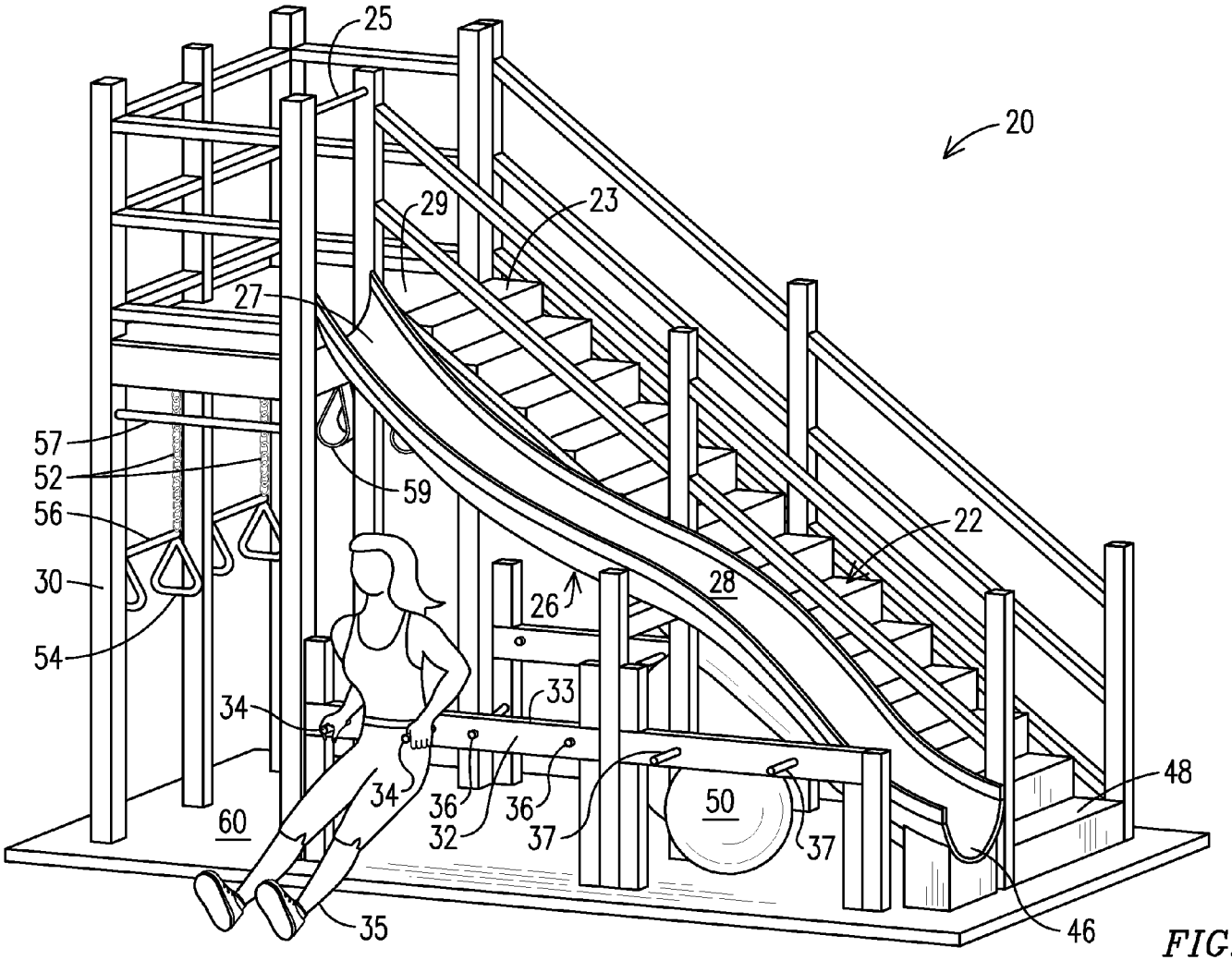
FIG. 1 is a left front perspective view of an embodiment of the invention with a user doing dips.

FIGS. 1-5 illustrate a multiple exercise apparatus 20 in an exemplary embodiment of the invention. A flight of stairs 22 and a slide 26 are attached to or part of a support structure such as a frame 30. A landing or platform 29 spans between the upper end 23 of the flight of stairs 22 and the upper end 27 of the slide 26, so that a person can walk from the stairs to the slide. One or more members 32 of the frame have a horizontal upper surface 33 within 3 feet of a ground level or floor 60, or preferably 16-22 inches above the floor for sitting as later described. One or more pairs of hand grips 34, 36, 37 are attached to such frame member 32 within 6 inches below the upper surface 33 or preferably within 3 inches thereof.

The lower end 46 of the slide 26 may be located immediately beside the lower end 48 of the stairs 22 as shown. This allows a user to repeatedly climb the stairs and slide down to the foot of the stairs without traversing a distance from the slide to the stairs. A horizontal safety bar 25 may be provided above the slide entrance at its upper end 23 to assist a user in sitting down on the slide 26. The slide 26 and stairs 22 may be generally parallel as shown. This configuration makes the apparatus 20 compact, and provides an area underneath for storage of other equipment such as exercise balloons 50. A portion of this storage area may be enclosed (not shown). In any case, it at least provides shade in outdoor installations.

One or more pairs of hand grips 34, 36, 37 extend outwardly from the member 32 at an angle of 0-40 degrees from horizontal. The term "outwardly" in this context means distally with respect to the apparatus 20. It is possible to provide multiple pairs of hand grips 34, 36, 37 at the same or different angles. For example, one pair of hand grips 34 might be horizontal for dips, while another pair 37 might be angled 15-40 degrees from horizontal, or especially 30 degrees from horizontal, for inclined push-ups as later described. The hand grips may be retractable into or against the frame member 32 as shown by retracted hand grips 36.

The slide may have a peak 28 within a lower half of its length. A pair of hand grips 37 may be located below and beside the peak 28 as shown. This provides more headroom for a user doing inclined push-ups on the hand grips 37 than would be provided with a straight slide. This facilitates inclined push-ups on one more pair of hand grips 37 for a given footprint of the apparatus 20 than would be the case with a straight slide.

For dip exercises, a pair of the hand grips 34 may extend outwardly from the frame member 32 at an angle of 0-10 degrees from horizontal. As shown in FIG. 1, a user 35 may perform dips with her heels on the ground, partly supporting her weight. The heights of the upper surface 33 and the hand grips 34, makes it easy to for a user to position herself for dips by sitting on the upper surface 33 between the grips 34 with her hands on the grips 34, facing outward, and then sliding forward off the upper surface 33 into the dip position.

Figure 2:
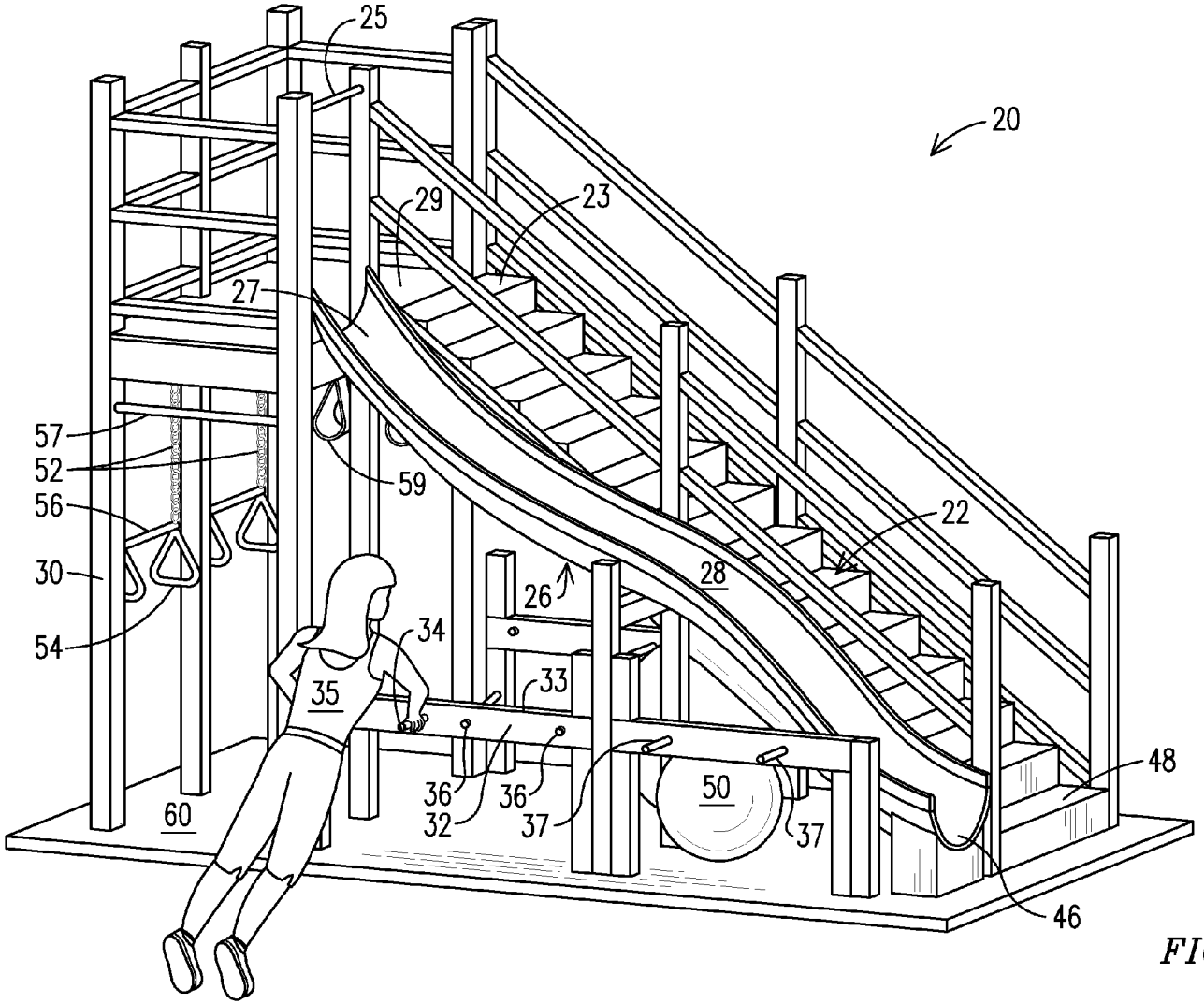
FIG. 2 is a view as in FIG. 1 with a user doing inclined push-ups.

FIG. 2 shows a user 35 performing inclined push-ups by facing the hand grips 34, grasping them, and moving her feet back into an inclined position of the body supported between her toes and the grips 34. The proximity of the hand grips 34 to the upper surface 33, especially within 3 inches, allows a user to lower her chest close to the level of the hand grips 34 or between them during push-ups. A given pair of hand grips may have an inclined angle such as 30 degrees to approximately match an incline of a user's body for comfort of the wrists.

Inclined push-ups reduce stress compared to horizontal push-ups. Push-ups at an incline of 30 degrees require only about 87% of the force of horizontal push-ups. An alternate way to reduce push-up stress is by doing push-ups from the knees. However, doing push-ups from the toes are beneficial in strengthening the knee extensor aspects of the quadriceps (frontal thigh muscles). Push-ups from the knees lack this benefit. The present hand grips also have advantages over a push-up bar such as in FIG. 4 of U.S. Pat. No. 7,060,002, because the present hand grips 34 correspond to the natural angle of the hands when held beside the torso, thus reducing stress on the wrists.

Figure 3:
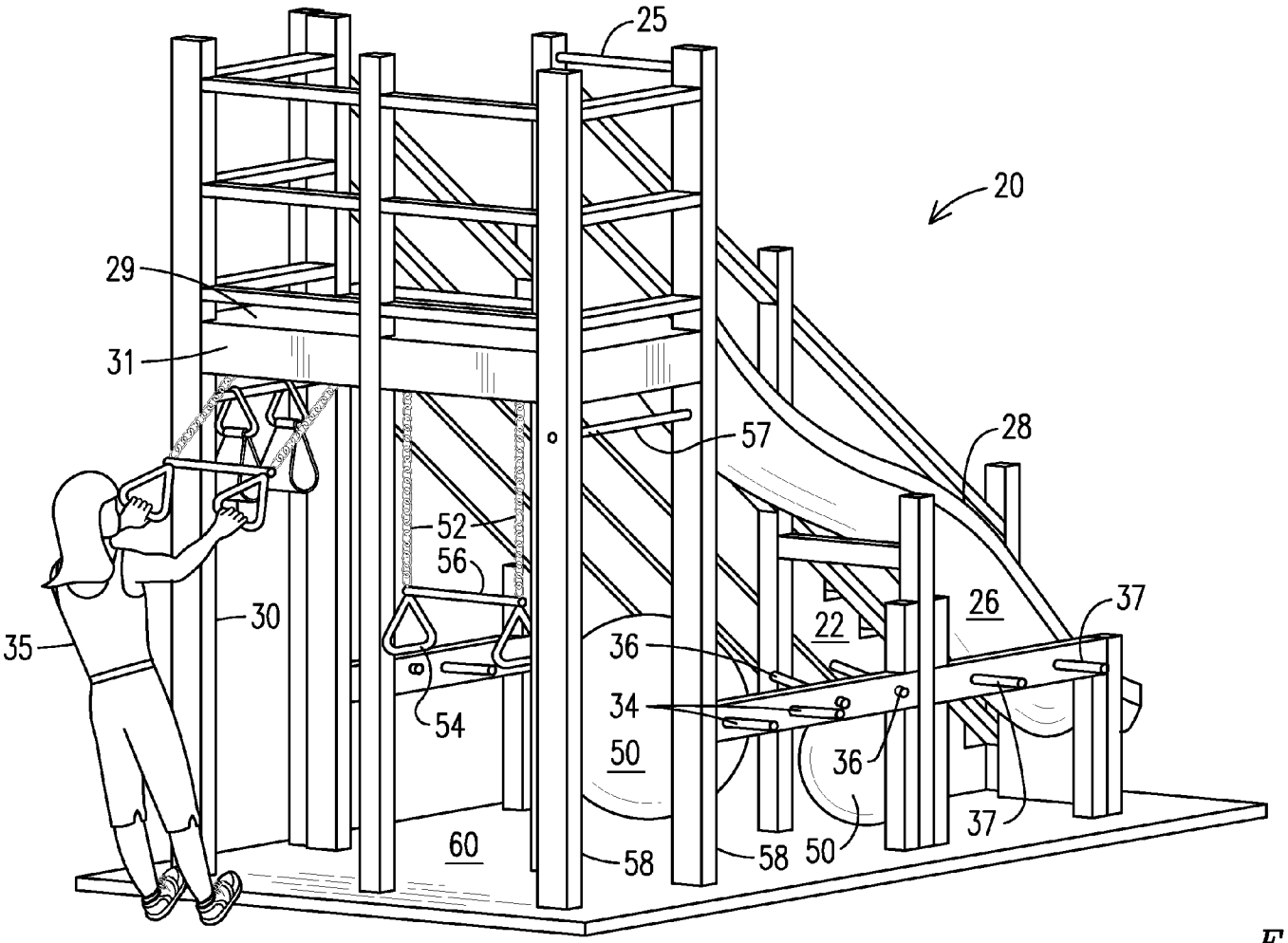
FIG. 3 is a left back perspective view of the embodiment of FIG. 1 with a user doing inclined pull-ups.

As shown in FIG. 3 a pair of suspenders such as chains 52 may hang vertically from the frame 30, especially from a support beam 31 of the platform 29. The suspenders may alternately be implemented as cables, ropes, cords, or lines. A hand ring 54 may be attached to the bottom end of each chain 52 and/or a horizontal bar 56 may be attached between the bottom ends of two chains 52. This allows a user 35 to grip the rings 54 or bar 56 in an inclined pull-up position supported from the user's heels as shown. The chains 52 may hang below the platform 29 as shown. The hand rings 54 may be mounted 4-5 feet above the floor 60 so as to be reachable by children and adults. Optionally, only hand rings 54 may be attached to a first pair of chains 52 while only a horizontal bar 56 may be attached to a second pair of chains. However, when they are both provided on the same pair of chains as shown, the bar 56 maintains a stable distance between the hand rings, and using the rings allows the wrists to assume their most comfortable angle.

A non-pendulous horizontal stretching bar or pull-up bar 57 may be mounted between two vertical elements 58 of the frame 30 at a position higher than the suspended bar(s) 56, to allow full-weight pull-ups and/or shoulder stretching. This bar 57 may be mounted on brackets (not shown) extending outside the shadow of the platform 29 to avoid interference of the platform support beams with a user doing pull-ups.

Figure 4:
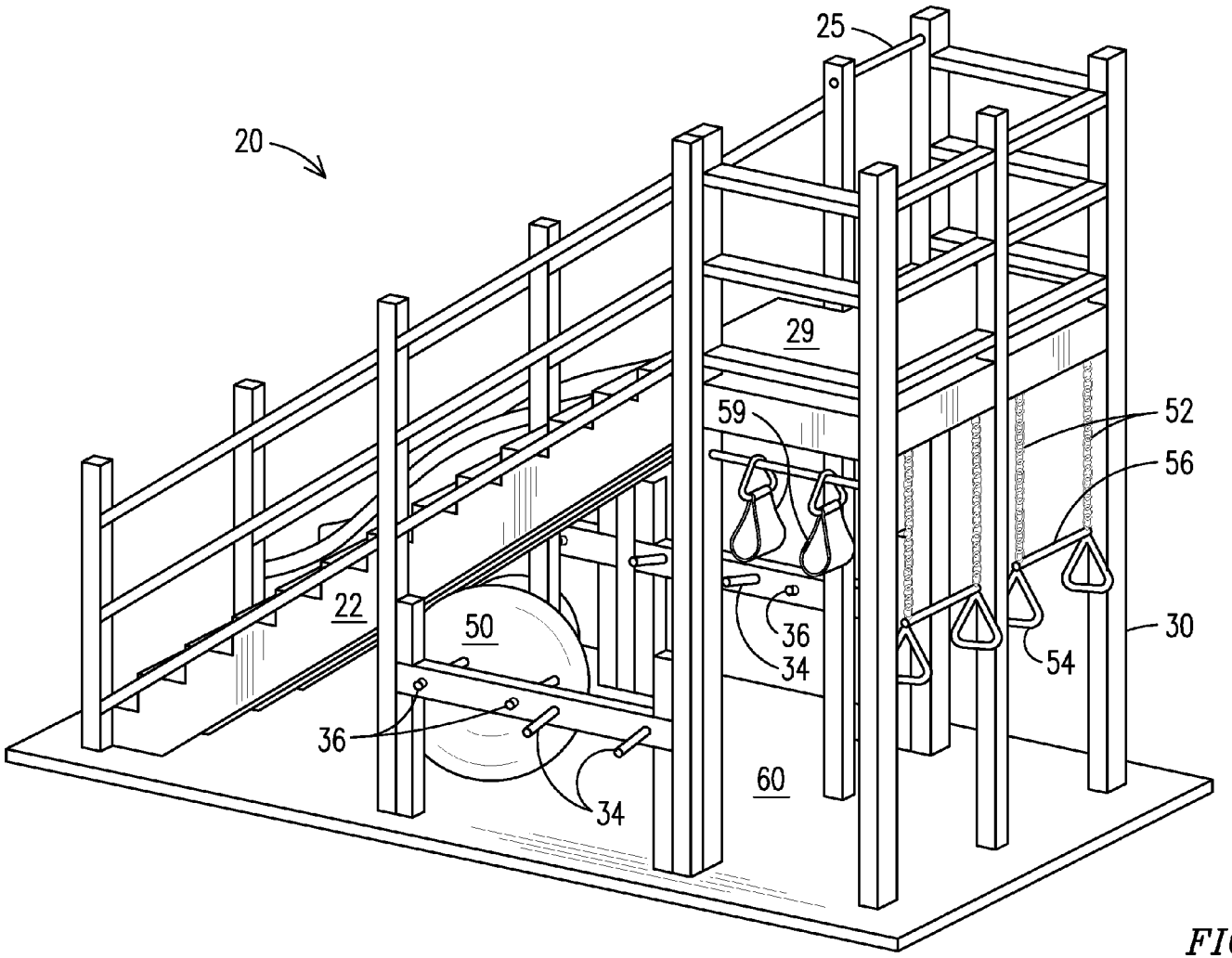
FIG. 4 is a right back perspective view of the embodiment of FIG. 1.

FIG. 4 shows abdominal cradles 59 hanging below the platform 29. A user can insert her arms into the cradles so the cradles support her upper arms. She can then hang from the cradles while raising her knees for abdominal exercise.

Figure 5:
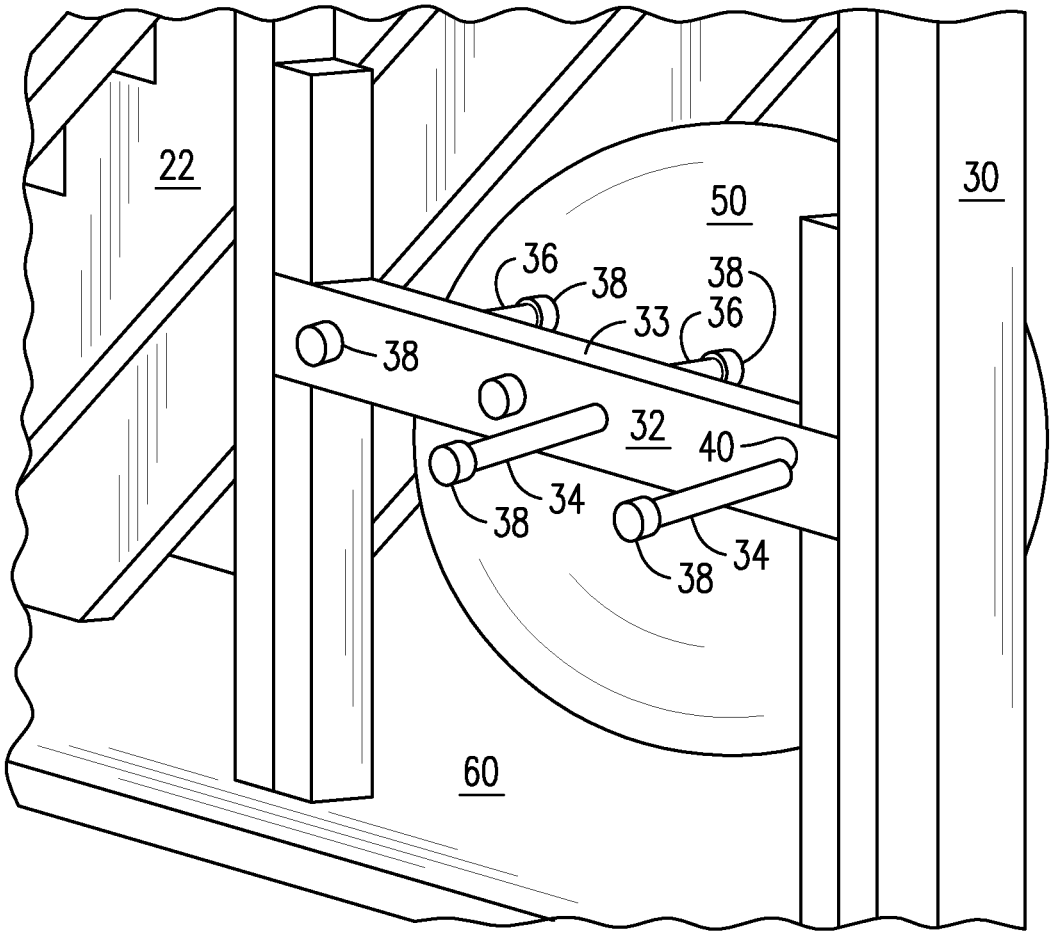
FIG. 5 is an enlarged view of exemplary hand grips of the invention.

FIG. 5 is an enlarged view of the hand grips 34, which may be made of cylindrical rods or pipes slidably inserted through respective holes 40 in a frame member 32. They may be retained in the holes by an enlargement such as a cap 38 or ball (not shown) on both ends of each rod or pipe, wherein the enlargement has a larger diameter than each respective hole 40. The hand grips 34 may be retracted by sliding them inward as shown at 36 to eliminate outward protrusion when not in use. Alternate retraction means such as hinges with lock-out pins are also possible.

In the illustrated configuration, the various exercise devices may all be arranged compactly below the stairs 22, slide 26, and platform 29 or within 10 inches of the vertical projection thereof in the case of the non-pendulous pull-up bar 57. This makes the apparatus 20 space-efficient. All parts of the stairs 22, slide 26, frame 30, and platform 29 contribute to the overall strength and rigidity of the apparatus 20. The support spars of the stairs 22 provide diagonal bracing to the frame 30, forming a triangular geometry among the stairs 22, frame 30, and floor 60 or ground. Thus the combination of exercise stations in a single framework as shown provides structural synergy in addition to convenience and space efficiency. It provides both aerobic exercises and upper-body strength exercises for one or more users concurrently.

Frame-type construction is shown in the exemplary embodiment herein. Alternately, portions or all of the apparatus may be formed by unibody or monocoque construction without separable frame elements such as beams. In such an implementation, frame terms like "frame member" as used herein mean an equivalent or corresponding structural portion of the unibody. The frame 30 as shown is an example of a support structure in general. The frame member 32 is an example of a hand grip mounting portion of the apparatus.

Although the present invention has been described herein with respect to preferred embodiments, the foregoing description is intended to be illustrative, not restrictive. Modifications of the present invention will occur to those skilled in the art. All such modifications that fall within the scope of the appended claims are intended to be within the scope and spirit of the present invention.

I claim:

1. An exercise apparatus comprising:

a flight of stairs and a slide attached to a support structure;

a platform between an upper end of the flight of stairs and an upper end of the slide;

a hand grip mounting portion of the support structure comprising a horizontal upper surface within 3 feet of a floor; and a first pair of hand grips attached to the hand grip mounting portion at a position within 6 inches below the upper surface thereof and extending therefrom at an orientation of 0-40 degrees from horizontal, wherein the first pair of hand grips is retractable into or against the hand grip mounting portion;

wherein the hand grips comprise cylindrical rods or pipes inserted slidably through respective holes in the hand grip mounting portion, and the rods or pipes are retained in the respective holes by an enlargement on each end of each rod or pipe, wherein the enlargement has a larger diameter than each respective hole.

2. The exercise apparatus of claim 1, wherein a lower end of the slide is disposed immediately beside a lower end of the stairs, whereby a user can repeatedly climb the stairs and slide down to the lower end of the stairs.

3. The exercise apparatus of claim 1, wherein the first pair of hand grips extend outwardly from the hand grip mounting portion at an angle of 0-10 degrees from horizontal, and further comprising a second pair of hand grips attached to a second hand grip mounting portion of the support structure at a position within 6 inches below a horizontal upper surface thereof and extending outwardly therefrom at an angle of 15-40 degrees below horizontal.

4. The exercise apparatus of claim 3, wherein the second pair of hand grips is attached to the second hand grip mounting portion within 3 inches below the upper surface thereof, and extends outwardly therefrom at an angle of 30 degrees below horizontal.

5. The exercise apparatus of claim 4, wherein the slide comprises a peak within a lower half of a length thereof, and the second pair of hand grips is located below and beside said peak, wherein the peak provides more headroom for a user doing inclined push-ups on the second pair of hand grips than would be provided with a straight slide.

6. An exercise apparatus comprising:

a flight of stairs and a slide attached to a support structure;

a platform between an upper end of the flight of stairs and an upper end of the slide;

a hand grip mounting portion of the support structure; and a pair of hand grips attached to the hand grip mounting portion and extending therefrom;

wherein the slide comprises a peak within a lower half of a length thereof, and the pair of hand grips is located below and beside said peak, wherein the peak provides more headroom for a user doing inclined push-ups on the pair of hand grips than would be provided with a straight slide.

7. The exercise apparatus of claim 6, wherein the hand grip mounting portion comprises a horizontal upper surface within 3 feet of a floor, and the hand grips are attached to the hand grip mounting portion within 6 inches below the horizontal upper surface.

8. The exercise apparatus of claim 7 wherein the hand grips extend outwardly from the hand grip mounting portion at an angle of 15-40 degrees below horizontal.

9. The exercise apparatus of claim 6, wherein the hand grips comprise cylindrical rods or pipes inserted slidably through respective holes in the hand grip mounting portion, and the rods or pipes are retained in the respective holes by an enlargement on each end of each rod or pipe, wherein the enlargement has a larger diameter than each respective hole.

10. The exercise apparatus of claim 6, wherein a lower end of the slide is disposed immediately beside a lower end of the stairs, whereby a user can repeatedly climb the stairs and slide down to the lower end of the stairs.

11. The exercise apparatus of claim 6, further comprising:

a pair of suspenders hanging vertically from a platform support portion of the support structure to hang below the platform;

a hand ring and/or a horizontal bar attached to a bottom end of each suspender.

12. The exercise apparatus of claim 11, further comprising a pair of abdominal cradles mounted on the support structure to hang below the platform for retention of the upper arms of a user hanging therefrom.

13. The exercise apparatus of claim 6, further comprising a horizontal safety bar mounted above the upper end of the slide to assist a user in sitting down on the slide.

14. The exercise apparatus of claim 6, wherein the hand grip mounting portion comprises a horizontal upper surface that is 16-22 inches above a floor, and the hand grips are attached to the hand grip mounting portion within 3 inches below the horizontal upper surface.

15. An exercise apparatus comprising:

a flight of stairs and a slide attached to a support structure;

a platform between an upper end of the flight of stairs and an upper end of the slide;

a hand grip mounting portion of the support structure; and a pair of hand grips attached to the hand grip mounting portion and extending therefrom;

wherein the hand grips comprise cylindrical rods or pipes inserted slidably through respective holes in the hand grip mounting portion, and the rods or pipes are retained in the respective holes by an enlargement on each end of each rod or pipe, wherein the enlargement has a larger diameter than each respective hole.

16. The exercise apparatus of claim 15, wherein the hand grip mounting portion comprises a horizontal upper surface within 3 feet of a floor, and the hand grips are attached to the hand grip mounting portion within 6 inches below the horizontal upper surface.

17. The exercise apparatus of claim 16 wherein the hand grips extend outwardly from the hand grip mounting portion at an angle of 15-40 degrees below horizontal.

18. The exercise apparatus of claim 17, wherein a lower end of the slide is disposed immediately beside a lower end of the stairs, whereby a user can repeatedly climb the stairs and slide down to the lower end of the stairs.

19. The exercise apparatus of claim 18, further comprising:

a pair of chains hanging vertically from the support structure;

a hand ring attached to a bottom end of each chain for a user to hang by the hands therefrom;

a pendulous horizontal bar attached between the bottom ends of the two chains;

a pair of abdominal cradles mounted on the support structure; and a stationary horizontal bar mounted between two vertical elements of the support structure.

20. The exercise apparatus of claim 19, wherein the hand grip mounting portion comprises a horizontal upper surface that is 16-22 inches above a floor, and the hand grips are attached to the hand grip mounting portion within 3 inches below the horizontal upper surface.

* * * * *